US005590496A

United States Patent [19]

Martin et al.

[11] Patent Number: 5,590,496

[45] Date of Patent: Jan. 7, 1997

[54] SHIPPING COVER HINGED NAILING FIN FOR USE WITH A FRAME ASSEMBLY

[75] Inventors: Jeffrey S. Martin, Cottage Grove; Michael K. Hoffman, Cannon Falls, both of Minn.

[73] Assignee: Amesbury Group, Inc., Amesbury, Mass.

[21] Appl. No.: 455,062

[22] Filed: May 31, 1995

[51] Int. Cl.[6] ..... E04B 1/04

[52] U.S. Cl. ..... 52/213; 206/321; 52/730.6; 52/745.14; 52/741.3

[58] Field of Search ..... 52/204.53, 204.66, 52/213, 214, 208, 730.3, 730.6, 745.13–745.16, 741.3; 206/321, 325

[56] References Cited

U.S. PATENT DOCUMENTS

| | | | |
|---|---|---|---|
| 3,623,288 | 11/1971 | Horowitz . | |
| 4,184,297 | 1/1980 | Casamayor . | |
| 4,821,472 | 4/1989 | Tix | 52/213 |
| 4,958,469 | 9/1990 | Plummer . | |
| 4,999,957 | 3/1991 | Kessler | 52/213 |
| 5,119,609 | 6/1992 | Tait et al. | 52/213 |

FOREIGN PATENT DOCUMENTS

| | | | |
|---|---|---|---|
| 0993978 | 6/1965 | United Kingdom | 52/214 |

*Primary Examiner*—Robert Canfield
*Attorney, Agent, or Firm*—Testa, Hurwitz & Thibeault, LLP

[57] ABSTRACT

A foldable shipping cover nailing fin for use with a frame assembly, including a window, door, or other such assembly. The shipping cover nailing fin includes an L-shaped flange-like member which includes an integrally formed insertion leg. The flange-like member is flexibly adjoined to a second member by a hinge mechanism. The hinge mechanism permits the flange-like member to rotate into contact with the second member. In this position, the insertion leg may be inserted into a nailing fin kerf formed in the frame assembly, thereby locking the shipping cover nailing fin to the frame assembly in the folded position.

33 Claims, 4 Drawing Sheets

SHIPPING COVER HINGED NAILING FIN FOR USE WITH A FRAME ASSEMBLY

INTRODUCTION

1. Field of Invention

The invention relates generally to nailing fins used in the construction industry to secure a frame assembly, such as a window or door assembly, to a surrounding support structure. More particularly, the invention relates to a foldable nailing fin which, in addition to providing the above function, provides an improved locking mechanism for holding the fin in the folded position while attached to the support structure.

2. Background

Nailing fins are commonly used in the construction industry to attach window or door frame assemblies to surrounding support structures. Foldable or bendable nailing fins may be attached to a frame assembly and shipped with the assembly as part of the shipping package. During shipping the fins may be secured to the frame assembly in an unfolded position as described in U.S. Pat. No. 5,119,609.

The invention described in U.S. Pat. No. 5,119,609 is a plastic nailing fin. During shipping, the nailing fin is attached to the edge of a frame in its "as molded" or "as extruded" form with one leg of the fin extending over the front or viewing surface of the frame.

The nailing fin includes a first leg and a second leg disposed at right angles to the first leg. The second leg has an integrally formed latch which extends slightly beyond the first leg. The second leg includes a hinge portion which divides it into inner and outer segments, with the inner segment being adjacent to the first leg. The outer segment has an integrally formed hook on one side and on the other side an integrally formed retention member. The retention member attaches the nailing fin to the frame.

When secured to the frame for attachment to a surrounding support structure, the inner segment is folded about the hinge and brought into engagement with the outer segment. The latch engages the hook of the outer segment, locking the inner segment in the folded position. The locking mechanism, a latch/hook combination, is designed to prevent the nailing fin from inadvertently springing back to its unfolded position.

If the locking mechanism fails or does not securely fasten, the nailing fin may snap back to its unfolded position, thus creating a risk that the nailing fin may become dislodged from the support structure. Additionally, if the hinge portion fails, the locking mechanism may not hold the nailing fin in the locked position. The present invention overcomes many of the limitations of prior art devices.

SUMMARY OF THE INVENTION

The present invention relates to a foldable shipping cover nailing fin for use with a window, door, or other similar assembly having a peripheral frame. When the frame assembly is a window assembly, the assembly includes a glazing surrounded by a peripheral frame.

The shipping cover nailing fin of the present invention is an integrally formed extruded strip of plastic material. It includes an L-shaped flange-like member, a second member, and a flexible hinge mechanism. During shipping, the shipping cover nailing fin is attached to the frame assembly in its unfolded position, forming a protective barrier around the frame assembly.

The L-shaped flange-like member may be made of a generally stiff material such as plastic, and it may define nailing holes by which the shipping cover nailing fin can be secured to a support structure adjacent to the frame. The L-shaped flange-like member may include an integrally formed insertion leg used to attach the shipping cover nailing fin to the frame assembly.

The insertion leg is an elongated member which extends vertically from the horizontal portion of the L-shaped flange-like member. The insertion leg is formed of a generally stiff material such as plastic, and it may include resilient barb-like protrusions extending from its outer perimeter. When the insertion leg is inserted into a kerf formed in the frame assembly, the barb-like protrusions frictionally engage the sidewalls of the kerf, locking the nailing fin in the folded position.

Another element of the shipping cover nailing fin, the second member, is formed of a generally stiff material such as plastic. The second member has an elongated edge which is parallel to and adjoins an elongated edge located on the L-shaped flange-like member. The second member includes an attachment mechanism which secures it to the frame assembly. The attachment mechanism may be double-sided adhesive tape.

The shipping cover nailing fin also includes a flexible hinge mechanism which joins the L-shaped flange-like member and the second member. The hinge mechanism may be a strip of resilient material which may be integrally formed with the L-shaped flange-like member and the second member. The hinge mechanism joins the L-shaped flange-like member and the second member together to form a unitary strip.

Each identified component of the shipping cover nailing fin, the L-shaped flange-like member, the second member, and the hinge mechanism, may be constructed to have substantially the same thickness. These components may be formed by coextrusion from the same or different materials. For example, the L-shaped flange-like member and the attachment member may be made of polyvinylchloride, and the hinge mechanism may be made from polyester or polyurethane.

The improved locking mechanism of the present invention overcomes some of the limitations of the prior art by using an insertion leg which frictionally engages the frame assembly as the locking mechanism. The locking mechanism of the present invention is easy to install, it provides a quick, reliable method of locking the fin in its folded position, and it maintains the nailing fin in the folded position even if the hinge mechanism fails.

It is an object of the invention to provide a shipping cover nailing fin which forms a protective barrier over a frame assembly during shipping.

It is another object of the invention to provide a shipping cover nailing fin which utilizes an insertion leg integrally formed with an L-shaped flange-like member as the mechanism for securing the nailing fin to a frame assembly in a locked, folded position.

The foregoing and other objectives, aspects, features, and advantages of the invention will become more apparent from the following description of the drawings, the detailed description, and the claims.

DETAILED DESCRIPTION

The present invention relates to a foldable shipping cover nailing fin for use with a window, door, or other similar assembly enclosed by, or having, a peripheral frame. The frame assembly typically includes a panel enclosed by a frame. When the frame assembly is a window assembly, the assembly includes a glazing G enclosed by a surrounding frame. While the inventive shipping cover nailing fin can be used advantageously with any of the described frame assemblies, and other types of assemblies, the following description is cast in terms of the invention's use with a window assembly which includes a surrounding or peripheral frame. This description is not intended, however, to limit the scope of the invention in any way.

Figure 1:
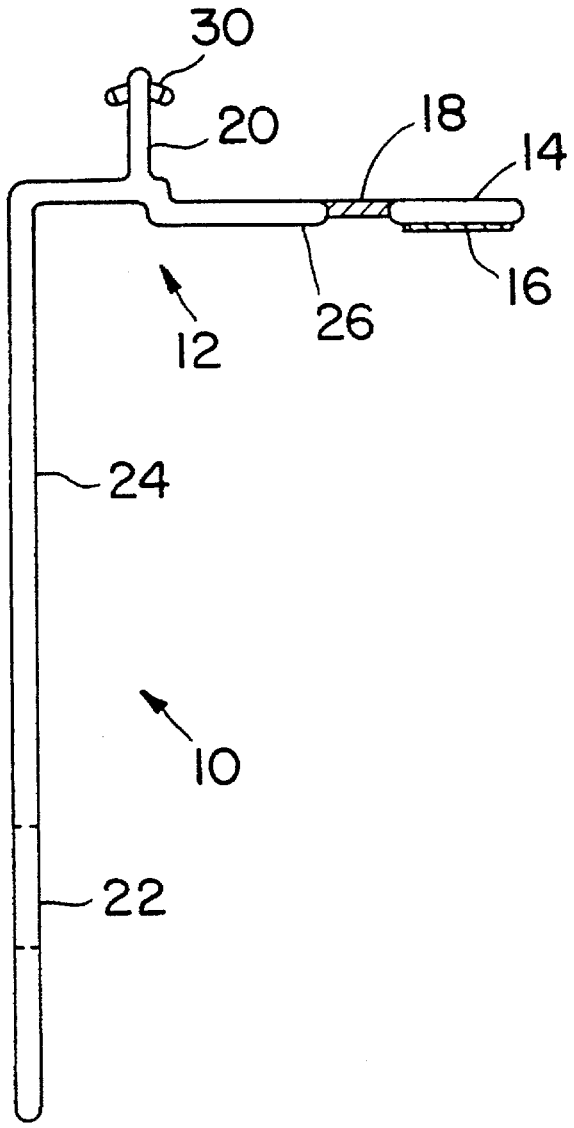
FIG. 1 is a plan view of a foldable shipping cover nailing fin formed in accordance with the teachings of the present invention, the fin being shown in its unfolded configuration.

Referring now to FIG. 1, there is shown a shipping cover nailing fin 10 formed in accordance with the present invention. The shipping cover nailing fin 10 includes an L-shaped flange-like member 12, a second member 14, and a hinge mechanism 18. The L-shaped flange-like member 12 includes a vertical portion 24 and a horizontal portion 26.

The vertical portion 24 defines nailing holes 22 used to attach the shipping cover nailing fin 10 to a support structure S surrounding the window assembly 28. Of course, other attachment devices such as staples, brads, or the like may be used as the method of attaching the shipping cover nailing fin 10 to the support structure. Depending on the selected attachment device, the L-shaped flange-like member 12 may or may not include nailing holes 22.

The horizontal section 26 of the L-shaped flange-like member 12 includes an integrally formed insertion leg 20. The insertion leg 20 extends vertically from the horizontal section 26 of the L-shaped flange-like member 12. The insertion leg 20 has flexible elongated barbed protrusions 30 extending from its outer perimeter. The barbed elements 30 frictionally engage the interior wall of a traditional nailing fin kerf 32 formed in the window assembly 28.

The shipping cover nailing fin 10 also includes a second member 14. The second member 14 is an elongated strip of generally stiff material such as plastic. The second member has an elongated edge **17*b* which is parallel to and adjoins an elongated edge 17*a* located on the horizontal portion 26 of the L-shaped flange-like member 12**.

Figure 2:
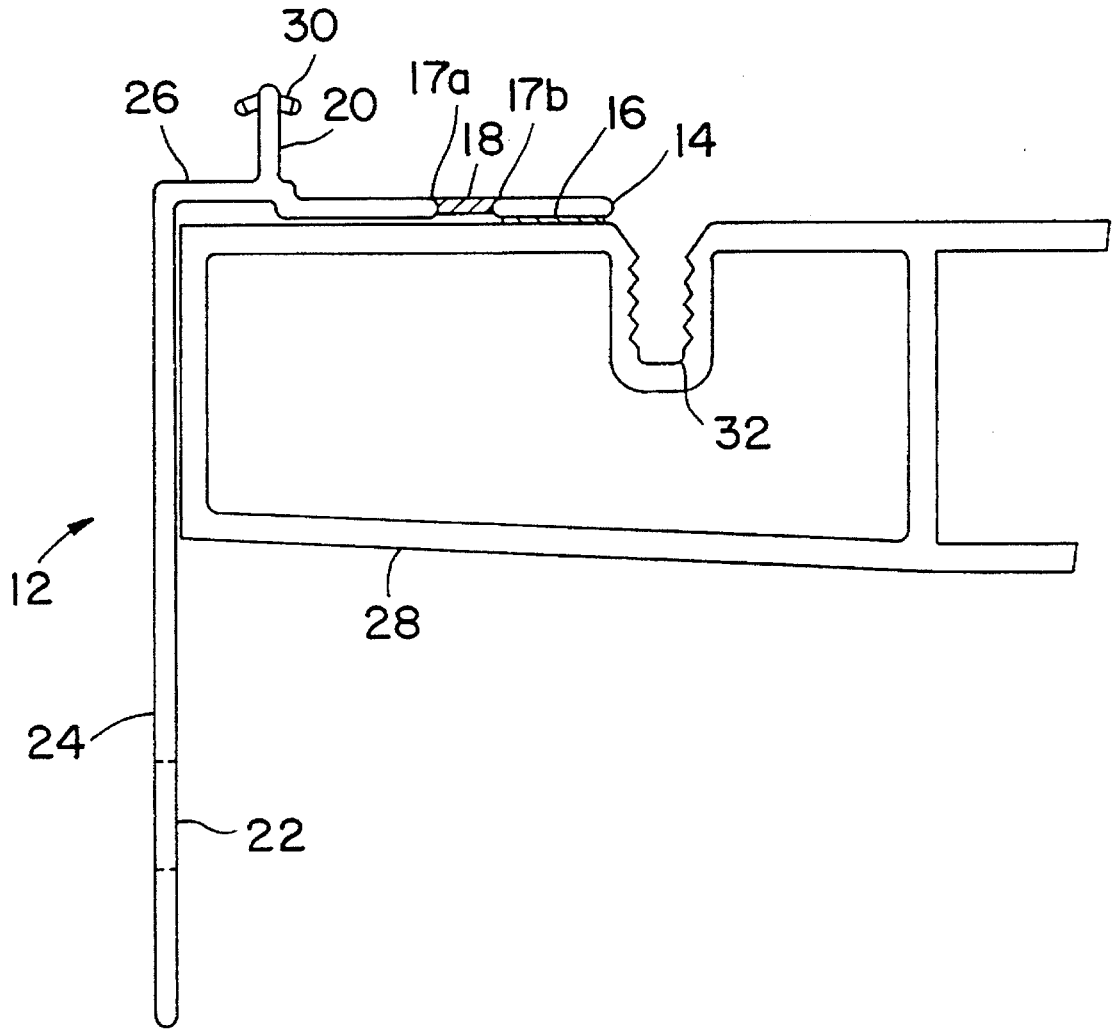
FIG. 2 is a plan view of the shipping cover nailing fin shown in FIG. 1 secured to a frame and arranged for packaging and shipping of the frame assembly.

During shipping, the shipping cover nailing fin 10 is attached to the window assembly 28 as shown in FIG. 2. In the shipping position, the L-shaped flange-like member 12 extends along the outer edges of the window assembly 28 to create a protective barrier around the window frame. The vertical portion 24 of the L-shaped flange-like member extends along the outer periphery of the window assembly 28. The horizontal portion 26 of the L-shaped flange-like member 12 and the second member 14 extend along an adjacent surface of the window assembly 28. The shipping cover nailing fin 10 is secured to the window assembly 28 by the second member 14.

The second member 14 includes an attachment mechanism 16 which secures the shipping cover nailing fin 10 to the window assembly 28 in the shipping position. The attachment mechanism 16 is double-sided adhesive tape. In various embodiments of the invention, a variety of mechanisms can be used to couple the second member 14 to the window assembly 28. For example, mechanical devices such as nails or staples may be used in addition to the chemical adhesive described. Moreover, a second barb can be formed on the second member 14 for interfitting with a second kerf (not shown) formed in the window assembly 28. It should be appreciated, therefore, that the invention is not limited to any specific manner of affixing the second member 14 to the window assembly 28.

At the construction site, the shipping cover nailing fin 10 and window assembly 28 combination is used to properly align the window assembly 28 relative to a surrounding support structure. To ready the shipping cover nailing fin 10 for attachment to a surrounding support structure, the L-shaped flange-like member 12 is folded about the hinge mechanism 18.

Figure 3:
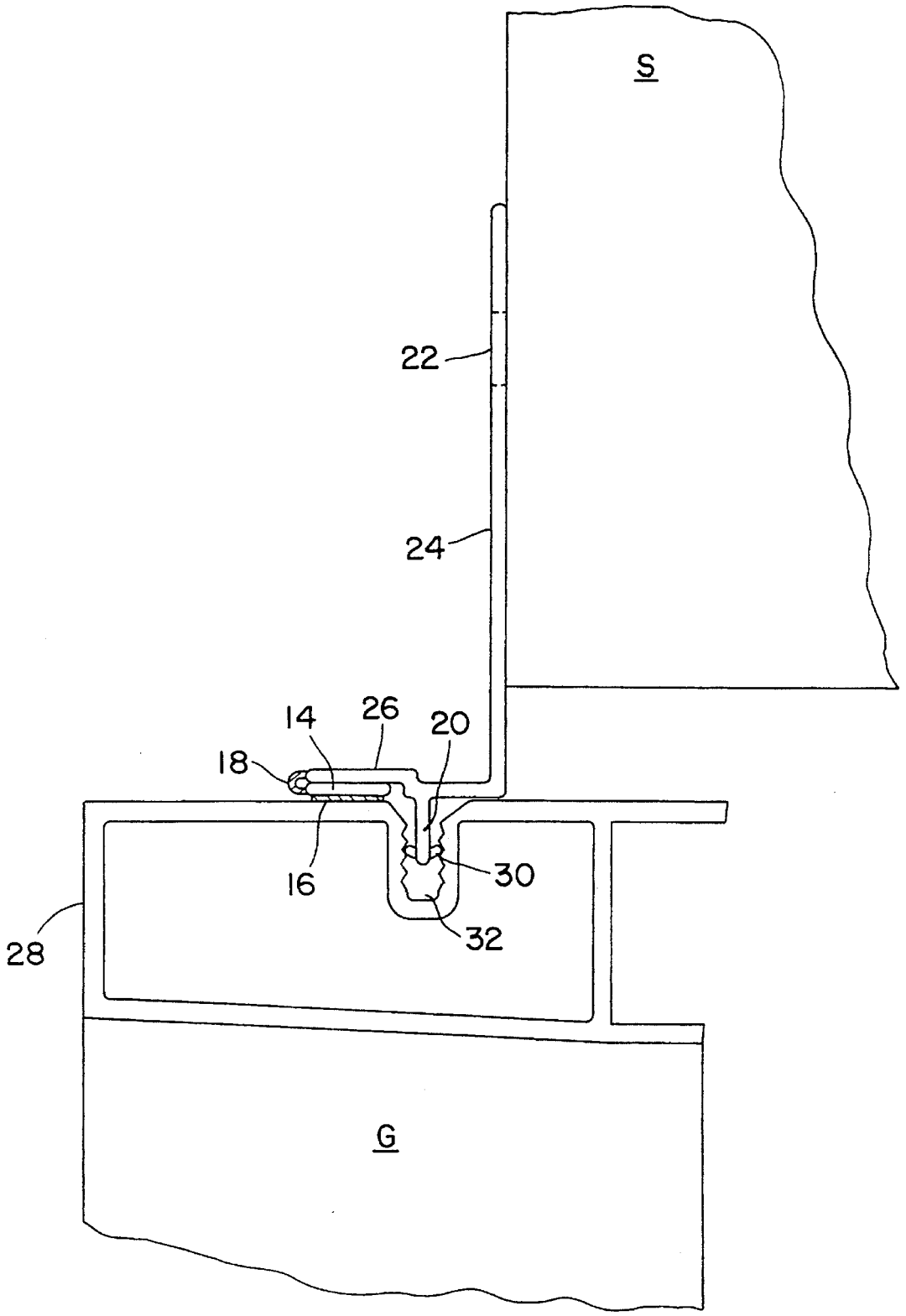
FIG. 3 is a plan view of the shipping cover nailing fin shown in FIG. 1 attached to a frame assembly, the nailing fin being folded and locked in the frame assembly.

When the shipping cover nailing fin 10 is folded as shown in FIG. 3, the vertical section 24 of the L-shaped flange-like member 12 is rotated 180 degrees to extend along the support structure. The 180 degree rotation of the vertical section 24 of the L-shaped flange-like member 12 causes the horizontal section 26 of the L-shaped flange-like member 12 to become folded along the hinge mechanism 18. When folded as described, the horizontal section 26 of the L-shaped flange-like member 12 comes into interfacial contact with the second member 14.

When the shipping cover nailing fin 10 is rotated as described, the insertion leg 20 is inserted into the kerf 2 of the window assembly 28. The barbs 30 frictionally engage the inner surface of the kerf 32, securing the shipping cover nailing fin 10 to the window assembly 28 and locking the shipping cover nailing fin 10 to the window assembly 28 in the folded position. The shipping cover nailing fin 10 is secured to the surrounding support structure by inserting attachment devices such as nails through the nail holes 22 such that the shipping cover nailing fin 10 is affixed to the support structure.

The flexible hinge mechanism 18 permits the horizontal section 26 of the L-shaped flange-like member 12 to rotate into contact with the second member 14. The hinge mechanism 18 flexibly adjoins the elongated, parallel edge **17*a* of the horizontal portion 26 of the L-shaped flange-like member 12 to an adjacent elongated, parallel edge 17*b* of the second member 14. The hinge mechanism 18 is coextruded with the shipping cover nailing fin 10** to form a unitary structure.

The hinge mechanism 18 may be coextruded using polymers such as, but not limited to, polyurethane, flexible polyvinylchloride, polyester, or flexible thermoplastic elastomers. The shipping cover nailing fin 10 is coextruded using a plastic material such as polyvinylchloride ("PVC") to form the L-shaped flange-like member 12 and the second member 14. One of skill in the art will appreciate that the hinge mechanism 18 and the shipping cover nailing fin 10 can be coextruded from a single material such as PVC.

Figure 4:
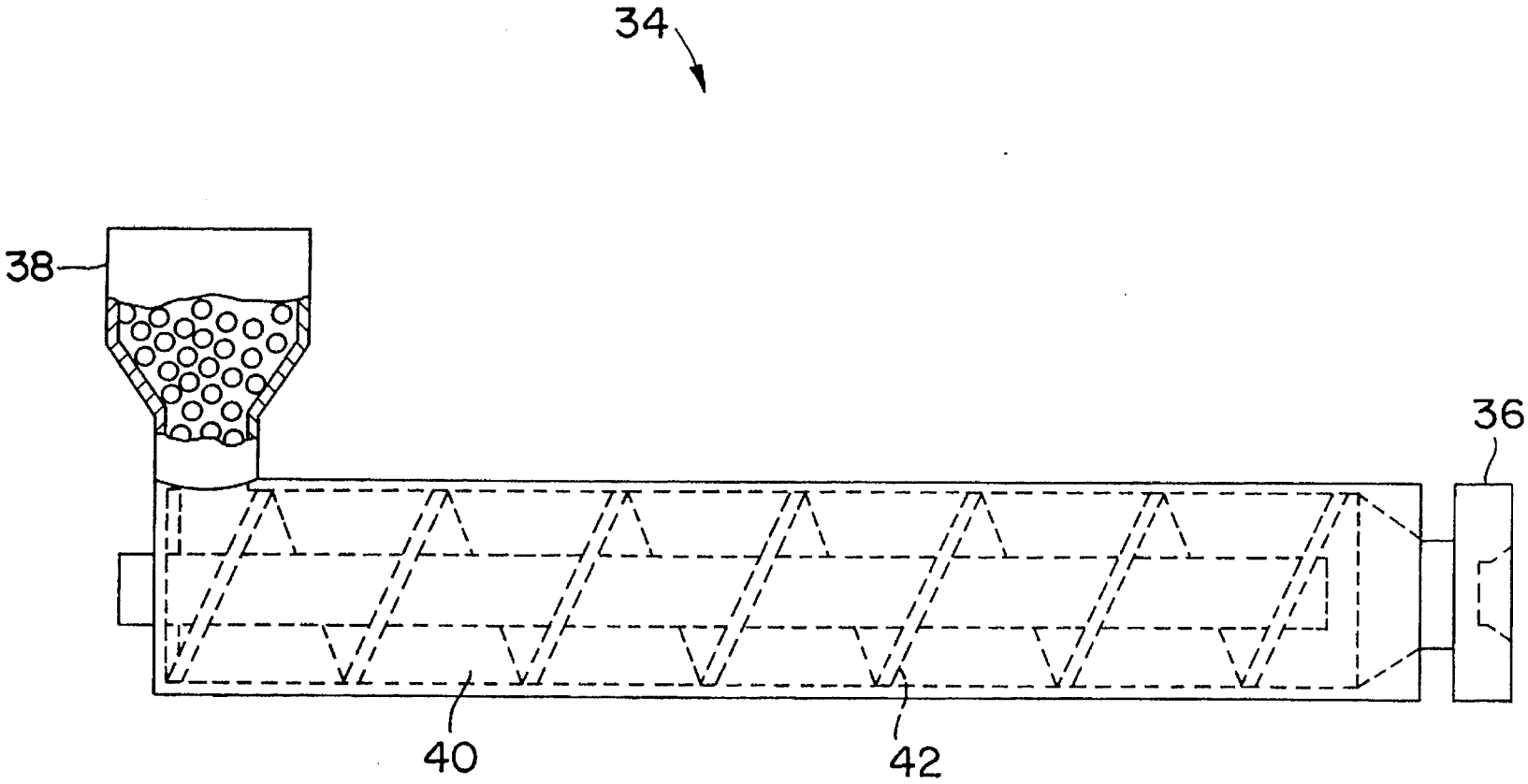
FIG. 4 is a plan view of an apparatus used to coextrude the shipping cover nailing fin shown in FIG. 1.

FIG. 4 shows one embodiment of an apparatus 34 used to form the shipping cover nailing fin 10. The apparatus 34 includes a die 36, a hopper 38, an extruder 40, an extruder screw 42, a puller, and a cutting means.

The die 36 is constructed of several metal plates which shape a plastic material to the final shape of the shipping cover nailing fin 10. The number of plates included in the die 36 may vary depending upon the complexity of the profile and the shape of the extrudate leaving the extruder 40 and entering the die 36. At least one plate of the die 36 is configured to receive the coextrusion material.

To form the shipping cover nailing fin 10, a plastic material is loaded into the hopper 38 of the extruder 40. Gravity feeds this material into the extruder's 40 throat where a rotatable screw 42 conveys the material forward. The churning action of the screw 42 causes the material to heat up and soften as it is conveyed forward. The material is softened to a point where it can be forced through the die 36 bolted to the front of the extruder 40.

The coextrusion member is formed by using a second extruder (not shown) coupled to the die 36. This second extruder feeds the coextrusion material into the die 36 to form the hinge mechanism 18 of the shipping cover nailing fin 10. The die 36 causes the plastic material and the coextrusion material to come into contact with one another before leaving the die 36. The plastic material and the coextrusion material join together to form an extrudate of the shipping cover nailing fin 10.

A puller (not shown) pulls the extrudate from the die 36 at a constant rate over a water or air tank in order to facilitate cooling of the extrudate. After the puller, a cutting mechanism such as a saw or knife cuts the extrudate to the desired length.

The describe apparatus 34 represents one method of extruding the shipping cover nailing fin 10. One of skill in the art will appreciate that other conventional extruding apparatuses can be used to form the shipping cover nailing fin 10.

The invention described herein defines a shipping cover nailing fin having an L-shaped flange-like member and a second member joined together by a flexible hinge mechanism. The hinge mechanism allows the L-shaped flange-like member to be folded into contact with the second member. In this position, an insertion leg which is integrally formed with the L-shaped flange-like member frictionally engages a kerf formed in a window assembly. This arrangement locks the nailing fin in the folded position while securing it to the window assembly.

While the invention has been described with respect to its preferred embodiments, it will be understood that various modifications and alterations will occur to those skilled in the art from the forgoing detailed description and the accompanying drawings. These modifications and alterations are intended to fall within the scope of the claims.

What is claimed:

1. For use with an assembly including a peripheral frame, a foldable shipping cover nailing fin comprising:

an L-shaped flange-like member formed of a generally stiff material configured to be directly attached to a support structure positioned adjacent to the peripheral frame, the L-shaped flange-like member further having thereon an integrally formed insertion leg for attaching the nailing fin to the peripheral frame;

a second member formed of a generally stiff material having an elongated edge parallel to and adjoining an elongated edge of the flange-like member; and a flexible hinge mechanism joining the flange-like member and the second member together.

2. The foldable nailing fin defined in claim 1 wherein the flange-like member defines nailing holes by which the nailing fin is adapted to be secured to the support structure.

3. The foldable nailing fin defined in claim 1 wherein the hinge mechanism comprises a strip of resilient material integrally formed with and joining the flange-like member and the attachment member together.

4. The foldable nailing fin defined in claim 1 wherein the second member includes an attachment mechanism.

5. The foldable nailing fin defined in claim 1 wherein the insertion leg is elongated and extends vertically from a horizontal portion of the L-shaped flange-like member, the insertion leg being formed of a generally stiff material and including resilient barb-like protrusions extending from the outer perimeter of the insertion leg, wherein the barb-like protrusions are adapted to frictionally engage a sidewall of a kerf formed in the peripheral frame, for securing the nailing fin to the peripheral frame and for locking the nailing fin in a folded position.

6. The foldable nailing fin defined in claim 1 wherein the flange-like member and the second member are formed from the same material.

7. The foldable nailing fin defined in claim 1 wherein the flange-like member and the second member are formed from different materials.

8. The foldable nailing fin defined in claim 1 wherein the flange-like member, the second member, and the hinge mechanism are made of the same material.

9. The foldable nailing fin defined in claim 1 wherein the flange-like member and the second member are made of a material different from that used to form the hinge mechanism.

10. The foldable nailing fin defined in claim 1 wherein the flange-like member, the second member and the hinge mechanism have substantially equal thicknesses.

11. The foldable nailing fin defined in claim 10 wherein the flange-like member and the second member are made of polyvinylchloride.

12. The foldable nailing fin as described in claim 10 wherein the flange-like member, the second member, and the hinge mechanism are coextruded to form a unitary strip.

13. The foldable nailing fin defined in claim 12 wherein the hinge mechanism is formed of polyurethane.

14. A foldable shipping cover nailing fin for a window assembly having a window glazing enclosed by a surrounding frame, an elongated integrally extruded strip of plastic comprising:

an L-shaped flange-like member made of generally stiff material configured to be directly attached to a support structure surrounding the window assembly, the L-shaped flange-like member further having thereon an integrally formed insertion leg for attaching the nailing fin to the window assembly;

a second member made of generally stiff material having an elongated edge parallel to and adjoining an elongated edge of the flange-like member; and a flexible hinge mechanism joining the flange-like member and the second member together.

15. The nailing fin defined in claim 14 wherein the hinge mechanism comprises a strip of resilient material integrally formed with and joining the flange-like member and the second member together.

16. The nailing fin defined in claim 14 wherein second member includes an attachment mechanism.

17. The nailing fin defined in claim 14 wherein the insertion leg is elongated and extends vertically from a horizontal portion of the L-shaped flange-like member, the insertion leg being formed of a generally stiff material and including resilient barb-like protrusions extending from the outer perimeter of the insertion leg, wherein the barb-like protrusions are adapted to frictionally engage a sidewall of a kerf formed in the window assembly, for securing the nailing fin to the window assembly and for locking the nailing fin in a folded position.

18. In combination:

a window assembly comprising a window glazing enclosed around its edges by a surrounding window frame; and a foldable shipping cover nailing fin comprising:

an L-shaped flange-like member made of generally stiff material configured to be directly attached to a support structure surrounding the windows assembly the L-shaped flange-like member further having thereon an integrally formed insertion leg which attaches the nailing fin to the window assembly;

a second member made of generally stiff material having an elongated edge parallel to and adjoining an elongated edge of the flange-like member; and a flexible hinge mechanism joining the flange-like member and the second member together.

19. The combination defined in claim 18 wherein the second member includes an attachment mechanism.

20. The combination defined in claim 18 wherein the hinge mechanism comprises a strip of resilient material integrally formed with and joining the flange-like member and the second member together.

21. The combination defined in claim 18 wherein the insertion leg is elongated and extends vertically from a horizontal portion of the L-shaped flange-like member, the insertion leg being formed of a generally stiff material and including resilient barb-like protrusions extending from the outer perimeter of the insertion leg, wherein the barb-like protrusions are adapted to frictionally engage a sidewall of a kerf formed in the window assembly, for securing the nailing fin to the window assembly and for locking the nailing fin in a folded position.

22. For use with a door assembly having a peripheral frame, a foldable shipping cover nailing fin comprising:

an L-shaped flange-like member made of generally stiff material configured to be directly attached to a support structure positioned adjacent the peripheral frame, the L-shaped flange-like member further having thereon an integrally formed insertion leg for attaching the nailing fin to the door assembly;

a second member made of generally stiff material having an elongated edge parallel to and adjoining an elongated edge of the flange-like member; and a flexible hinge mechanism joining the flange-like member and the second member together.

23. The foldable nailing fin defined in claim 22 wherein the hinge mechanism comprises a strip of resilient material integrally formed with and joining the flange-like member and the second member together.

24. The nailing fin defined in claim 22 wherein the second member includes an attachment mechanism.

25. The foldable nailing fin defined in claim 22 wherein the insertion leg is elongated and extends vertically from a horizontal portion of the L-shaped flange-like member, the insertion leg being formed of a generally stiff material and including resilient barb-like protrusions extending from the outer perimeter of the insertion leg, wherein the barb-like protrusions are adapted to frictionally engage a sidewall of a kerf formed in the door assembly, for securing the nailing fin to the door assembly and for locking the nailing fin in a folded position.

26. For use with a frame assembly having a front viewing surface and an edge extending inwardly therefrom, a foldable shipping cover nailing fin comprising:

an L-shaped flange-like member made of generally stiff material for directly attaching to a surrounding support structure, the L-shaped flange-like member further having thereon an integrally formed insertion leg for attaching the nailing fin to the frame assembly;

a second member made of generally stiff material having an elongated edge parallel to and adjoining an elongated edge of the flange-like member; and a flexible hinge mechanism joining the flange-like member and the attachment member together.

27. The foldable nailing fin defined in claim 26 wherein the hinge mechanism comprises a strip of resilient material integrally formed with and joining the flange-like member and the second member together.

28. The foldable nailing fin defined in claim 26 wherein the second member includes an attachment mechanism.

29. The foldable nailing fin of claim 26 wherein the insertion leg is elongated and extends vertically from a horizontal portion of the L-shaped flange-like member, the insertion leg being formed of a generally stiff material and including resilient barb-like protrusions extending from the outer perimeter of the insertion leg, wherein the barb-like protrusions are adapted to frictionally engage a sidewall of a kerf formed in the frame assembly, for securing the nailing fin to the frame assembly and for locking the nailing fin in a folded position.

30. For use with a frame assembly during shipping, a foldable shipping cover nailing fin comprising:

an L-shaped flange-like member formed of a generally stiff material configured to be directly attached to a support structure positioned adjacent to the peripheral frame the L-shaped flange-like member further having thereon an integrally formed insertion leg for attaching the nailing fin to the peripheral frame;

a second member formed of a generally stiff material having an elongated edge parallel to and adjoining an elongated edge of the flange-like member, the second member including an attachment mechanism for securing the second member to the frame assembly; and a flexible hinge mechanism joining the flange-like member and the second member together.

31. The foldable shipping cover nailing fin defined in claim 30 wherein the attachment mechanism comprises double-sided adhesive tape.

32. For use with a shipping cover nailing fin attachable to a frame assembly in preparation for shipping, a process of attaching the nailing fin to the frame assembly comprising the steps of:

placing a nailing fin having an L-shaped flange-like member having an integrally formed insertion leg thereon and a second member, both components being made of generally stiff material, along an outer periphery of the frame assembly such that a vertical portion of the L-shaped flange-like member extends along an outer surface of the frame assembly and a horizontal portion of the L-shaped flange-like member and the second member extend along an adjacent outer surface of the frame assembly, providing the second member with an attachment mechanism, and securing the nailing fin to the adjacent outer surface of the frame assembly with the attachment mechanism.

33. The process defined in claim 32 wherein the attachment mechanism comprises double-sided adhesive tape.

* * * * *